US005787903A

United States Patent [19]

Blackshear

[11] Patent Number: 5,787,903

[45] Date of Patent: Aug. 4, 1998

[54] MANICURIST WORKSTATION

[76] Inventor: Mary Jane Blackshear, P.O. Box 1022, Keaau, Hi. 96749

[21] Appl. No.: 823,173

[22] Filed: Mar. 25, 1997

[51] Int. Cl.[6] ..... A45D 29/18; B26B 17/00

[52] U.S. Cl. ..... 132/73.5; 132/73; 55/473; 454/56

[58] Field of Search ..... 132/73, 73.5; 55/473, 55/DIG. 18; 454/56, 63; 96/142

[56] References Cited

U.S. PATENT DOCUMENTS

| | | | |
|---|---|---|---|
| 2,147,314 | 2/1939 | Percy | 312/196 |
| 3,784,270 | 1/1974 | DeLapp | 312/236 |
| 4,179,984 | 12/1979 | Gorcey | 454/56 |
| 4,252,054 | 2/1981 | Bakels | 454/56 |
| 4,329,002 | 5/1982 | Cowen et al. | 132/73.5 |
| 4,553,992 | 11/1985 | Boissinot et al. | 55/279 |
| 4,852,468 | 8/1989 | Harris | 132/73 |
| 5,112,373 | 5/1992 | Pham | 55/316 |
| 5,464,029 | 11/1995 | Rentz | 132/73.5 |

*Primary Examiner*—Gene Mancene
*Assistant Examiner*—Philogene Pedro
*Attorney, Agent, or Firm*—Larry D. Johnson

[57] ABSTRACT

A workstation apparatus for use by manicurists in the application of artificial nails and the like, to protect the technician and client from the debris and vapors generated in the nail application process. The provides a covered working surface and circulates the contaminated air through purifying filters, and conditions the temperature and humidity of the air, before returning the air to the work surface.

2 Claims, 4 Drawing Sheets

MANICURIST WORKSTATION

BACKGROUND OF THE INVENTION

1. Field of the Invention

This invention relates generally to beauty salon furniture and equipment, and more specifically to an improved workstation apparatus for use by manicurists in the application of artificial nails and the like.

2. Description of the Prior Art

The process of applying artificial fingernails generates organic and inoganic debris, as well as numerous contaminants. Known chemical contaminants for which there is a permissible exposure limit include: acetone, acetonitrile, benzoyl peroxide, ethyl acetate, ethyl ether, hydroquinone, methacrylic acid, 4-methoxyphenol, methylene chloride, methyl ethyl ketone, titanium dioxide, toluene, and 1, 1, 2-trichloro-1,2,2-trifluoroethane. Chemicals found in artificial nail products for which there are no permissible exposure limits include: butyl methacrylate, dimethyl p-toluidine, ethyl cyanoacrylate, ethyl methacrylate, ethylene glycol dimethacrylate, and isobutyl methacrylate.

Manicure workstations typically include a ventilation system which attempts to keep the air clean of such contaminants. When properly designed and installed, local exhaust systems (such as vented table systems) capture and remove most contaminants before they reach the air that the technician and customer breathe. Most known ventilation systems are designed to vent contaminated air to the outside, rather than inside the beauty salon. Systems that do recirculate the air within the beauty salon generally include a charcoal filter and a dust filter, both of which should both be changed frequently. However, ordinary dust filters do not remove toxic vapors from the air.

SUMMARY OF THE INVENTION

The manicurist workstation of this invention provides an improved workstation apparatus for use by manicurists in the application of artificial nails and the like, to protect the technician and client (as well as others in the ambient area) from the debris and vapors generated in the nail application process. The inventive apparatus provides a covered working surface and circulates the contaminated air through purifying filters, and conditions the temperature and humidity of the air, before returning the air to the work surface. Thus, the air is treated and recirculated, rather than simply evacuated to the outside environment. The apparatus is completely self-contained, except for electrical connections and (possible) plumbing connections.

The inventive apparatus includes a manicure table surface having a technician side and a client side, the table surface bearing a plurality of air vents for air recirculation. The table surface includes a pair of fingernail soak bowls, a plurality of electrical cord access ports, and a trash bin opening for disposal of solid debris. An optically transparent dome or hood portion generally covers the table surface and defines a controlled air volume above it. The hood portion includes a technician arm entry seal and a client arm entry seal on opposing sides thereof, so that the technician and client can insert their hands into the controlled air volume. The hood portion further includes a plurality of air vents for air recirculation, and a light for enhanced visibility of the work surface. The apparatus also has an air processing section including a fan portion, a filter portion, and a heater/humidity control portion, which is connected to the table surface air vents and hood portion air vents by ducts. A fluid provision section includes a warm water supply and a soiled water disposal container. Alternatively, the system can be connected to the buildings standard plumbing to provide a source of warm water, and a drain for soiled water disposal.

Thus, the manicurist workstation of this invention provides a domed filter system in an airtight unit that performs a purifying recirculation of the air by containing the offensive smell, toxic fumes, buffing residue and dust, and eliminating them through filters. The recirculated air can be heated to comfortable room temperature when needed, both for the comfort of the technician and client, as well as to keep the nail care products at a desirable temperature. The lighting is adjustable, and may be enhanced by palcement of inwardly-refelecting mirrors on the sides of the apparatus. The viewing areas are preferably constructed of tempered glass to protect the eyes of the technician and client. The armholes have a securing lip on the outer side to ensure air tight seal.

DETAILED DESCRIPTION OF A PREFERRED EMBODIMENT

Figure 1:
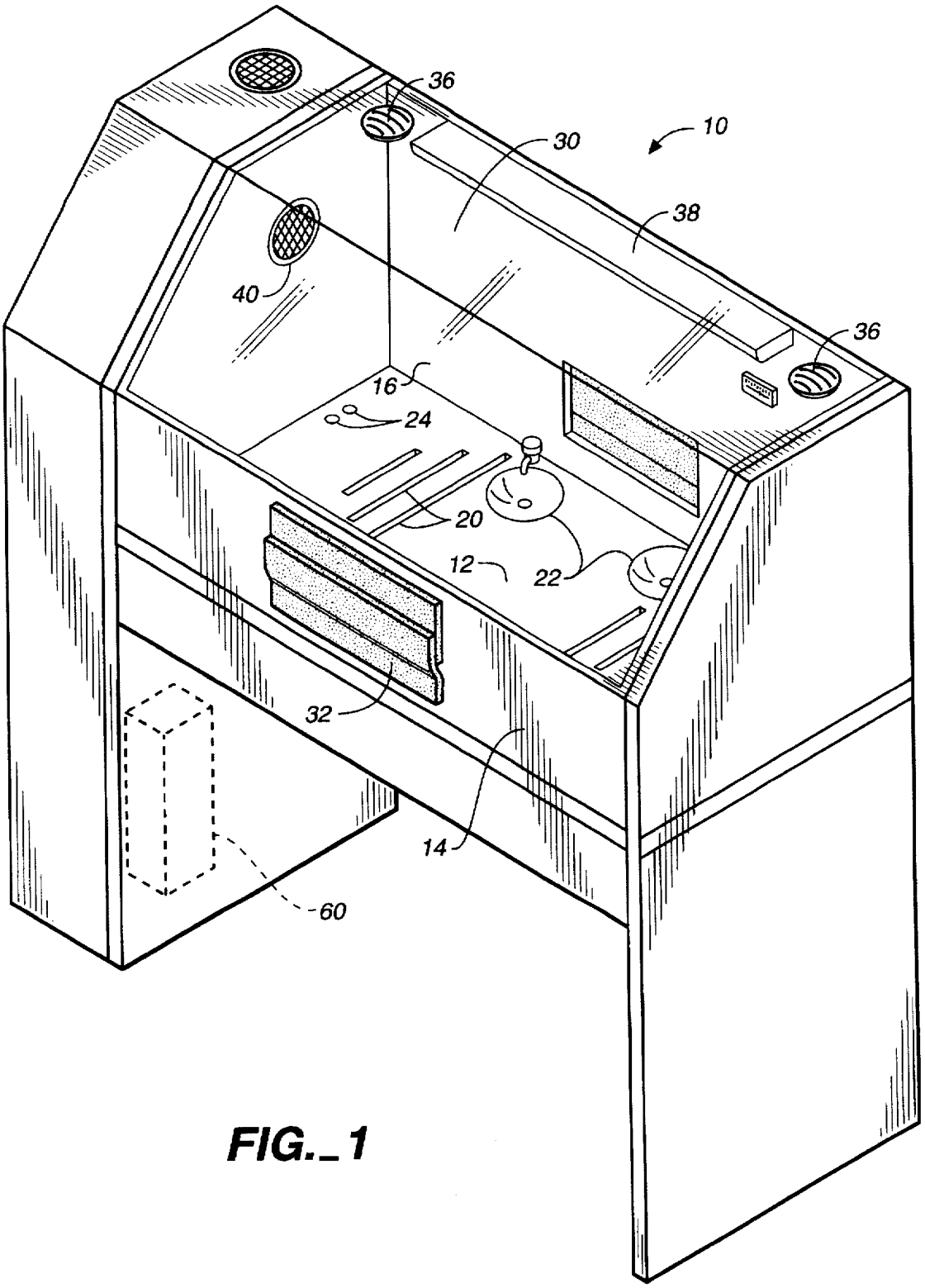
FIG. 1 is a perspective view of a manicurist workstation of this invention.
Figure 2:
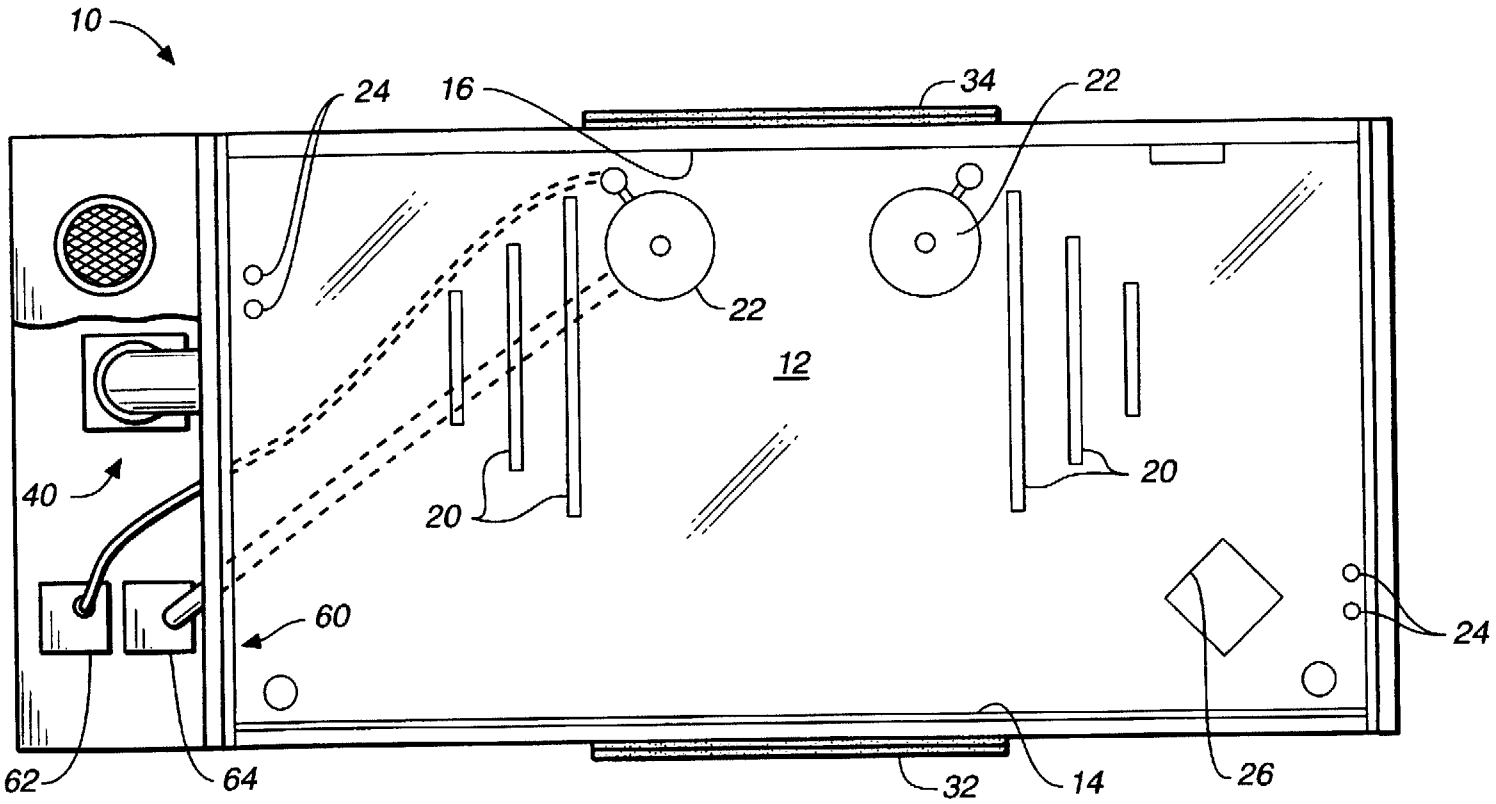
FIG. 2 is a cutaway top plan schematic view.
Figure 3:
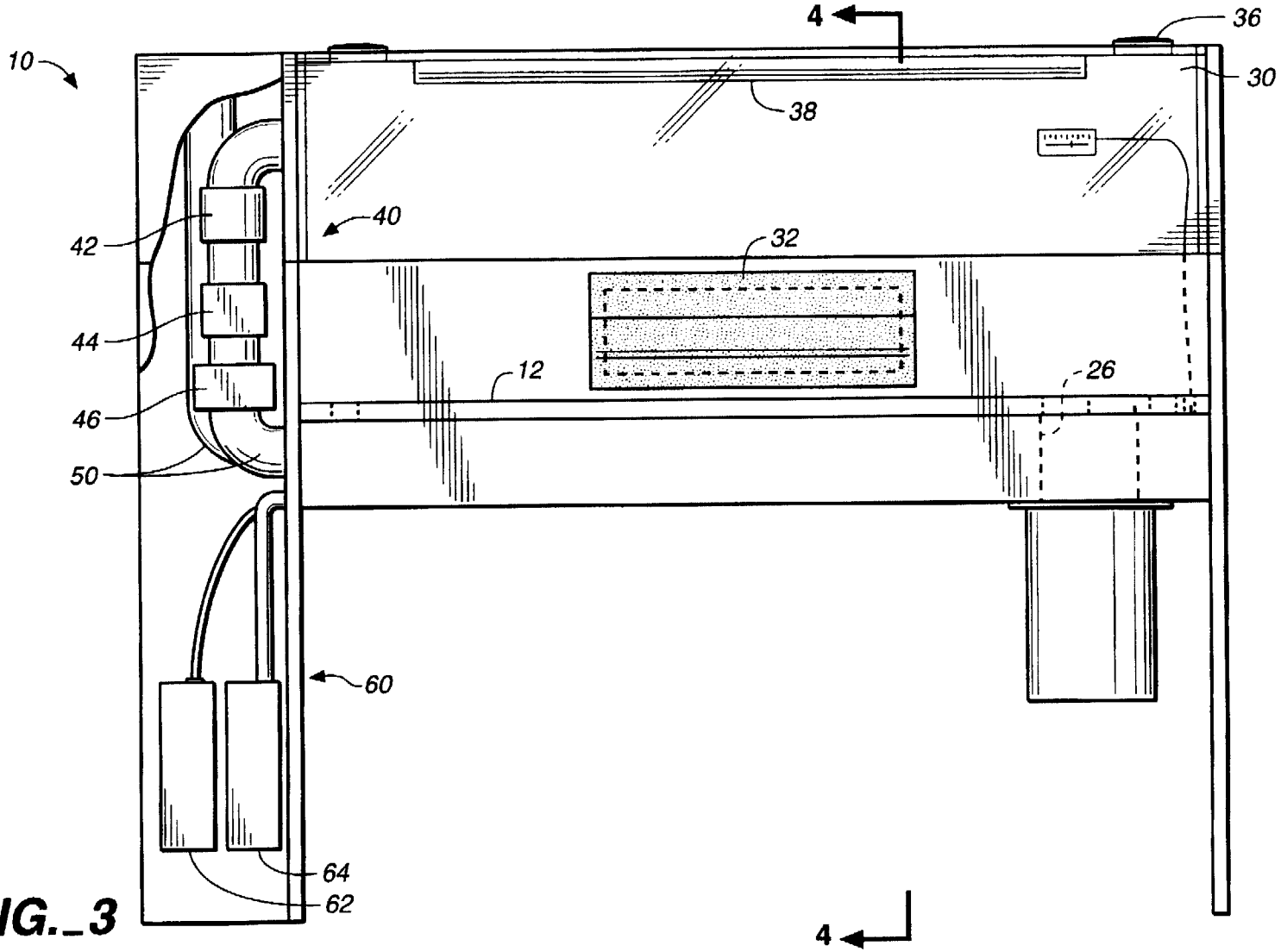
FIG. 3 is a front elevation schematic view of a manicurist workstation of this invention, these views illustrating the component parts of the inventive apparatus including a manicure table surface having a technician side and a client side, the table surface bearing a plurality of air vents, a pair of fingernail soak bowls, a plurality of electrical cord access ports, and a trash bin opening; a dome or hood portion generally covering the table surface and defining a controlled air volume, the hood portion including a technician arm entry seal and a client arm entry seal on opposing sides thereof, a plurality of air vents, and a light; an air processing section including a fan portion, a filter portion, and a heater/humidity control portion, the air processing section connected to the table surface air vents and hood portion air vents by ducts, and a fluid provision section including a warm water supply and a soiled water disposal container.

FIG. 1 is a perspective view of a manicurist workstation 10 of this invention, while FIG. 2 is a cutaway top plan schematic view, and FIG. 3 is a front elevation schematic view. These views illustrate the component parts of the inventive apparatus 10 including a manicure table surface 12 having a technician side 14 and a client side 16. The table surface 12 bears a plurality of air vents 20, a pair of fingernail soak bowls 22, a plurality of electrical cord access ports 24, and a trash bin opening 26. A dome or hood portion 30 generally covers the table surface 12 and defines a controlled air volume. The hood portion 30 includes a technician arm entry seal 32 and a client arm entry seal 34 on opposing sides thereof, a plurality of air vents 36, and a light 38. An air processing section 40 includes a fan portion 42, a filter portion 44, and a heater/humidity control portion 46. The air processing section 40 is connected to the table surface air vents 20 and hood portion air vents 36 by ducts 50. A fluid provision section 60 includes a warm water supply 62 and a soiled water disposal container 64, both plumbed to the soak bowls 22.

Figure 4:
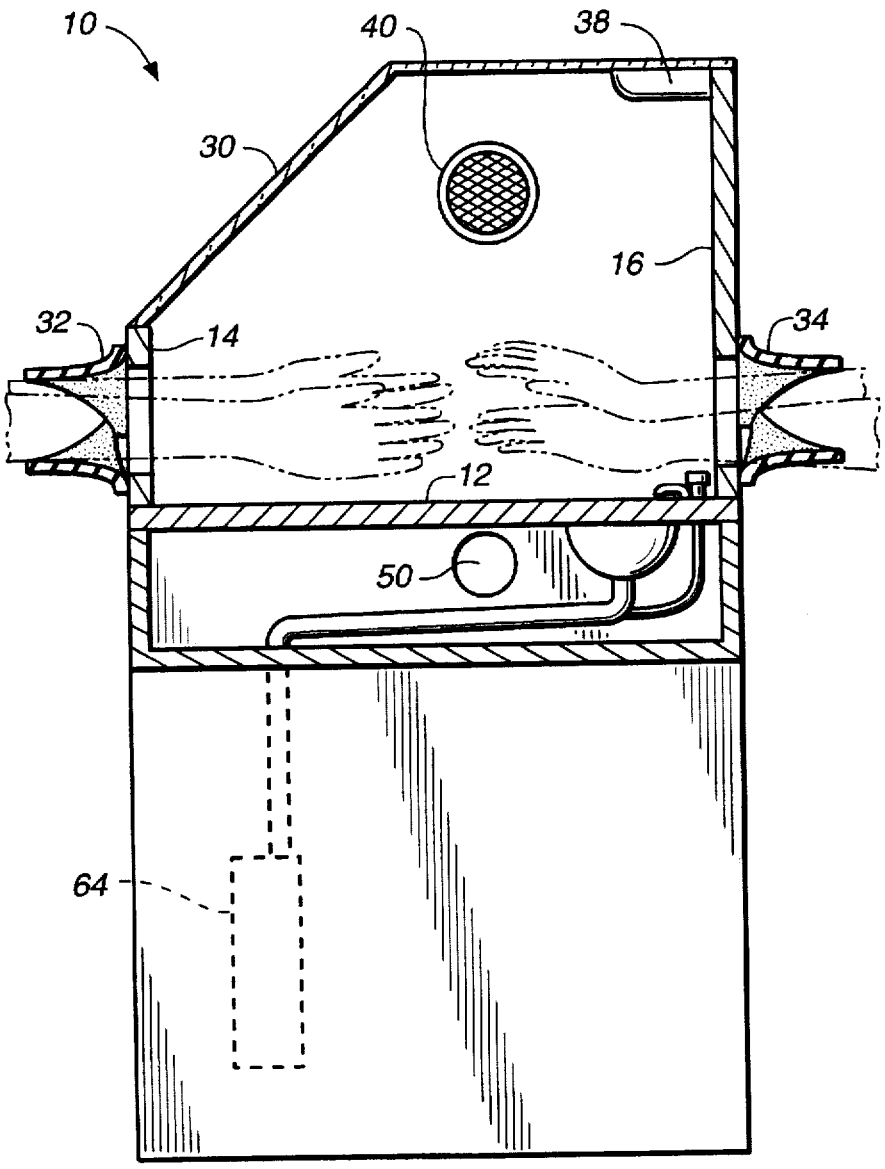
FIG. 4 is a side elevation cross-sectional view of a manicurist workstation of this invention illustrating a technician's hands and a client's hands having been inserted into the workstation controlled air volume through the respective arm entry seals.

FIG. 4 is a side elevation cross-sectional view of a manicurist workstation of this invention illustrating a technician's hands and a client's hands having been inserted into the workstation controlled air volume through the respective arm entry seals.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A manicurist workstation for use by a technician and client in the application of artificial nails, said workstation comprising:

a manicure table surface having a technician side and a client side, said table surface bearing a plurality of air vents for air recirculation, said table surface including a pair of fingernail soak bowls, a plurality of electrical cord access ports, and a trash bin opening for disposal of solid debris;

an optically transparent hood portion generally covering said table surface and defining a controlled air volume thereabove, said hood portion including a technician arm entry seal and a client arm entry seal on opposing sides thereof, and further including a plurality of air vents for air recirculation, and a light for enhanced visibility of said work surface; and an air processing section including a fan portion, a filter portion, and a heater/humidity control portion, connected to said table surface air vents and hood portion air vents by ducts.

2. A manicurist workstation for use by a technician and client in the application of artificial nails, said workstation comprising:

a manicure table surface having a technician side and a client side, said table surface bearing a plurality of air vents for air recirculation, said table surface including a pair of fingernail soak bowls, a plurality of electrical cord access ports, and a trash bin opening for disposal of solid debris;

an optically transparent hood portion generally covering said table surface and defining a controlled air volume thereabove, said hood portion including a technician arm entry seal and a client arm entry seal on opposing sides thereof, and further including a plurality of air vents for air recirculation, and a light for enhanced visibility of said work surface; and a fluid provision section including a warm water supply and a soiled water disposal container connected to said fingernail soak bowls.

* * * * *